US010609953B2

(12) United States Patent
Richardson

(10) Patent No.: US 10,609,953 B2
(45) Date of Patent: Apr. 7, 2020

(54) SMOKING ARTICLE COMPONENT

(75) Inventor: John Richardson, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 519 days.

(21) Appl. No.: 13/516,282

(22) PCT Filed: Nov. 30, 2010

(86) PCT No.: PCT/EP2010/068527
§ 371 (c)(1),
(2), (4) Date: Jan. 23, 2013

(87) PCT Pub. No.: WO2011/073025
PCT Pub. Date: Jun. 23, 2011

(65) Prior Publication Data

US 2013/0118509 A1 May 16, 2013

(30) Foreign Application Priority Data

Dec. 16, 2009 (GB) ..... 0921930.4

(51) Int. Cl.
*A24D 1/02* (2006.01)
*A24D 3/08* (2006.01)
*A24D 3/06* (2006.01)

(52) U.S. Cl.
CPC ..... *A24D 1/02* (2013.01); *A24D 3/06* (2013.01); *A24D 3/066* (2013.01); *A24D 3/08* (2013.01)

(58) Field of Classification Search
None
See application file for complete search history.

(56) References Cited

U.S. PATENT DOCUMENTS

| | | | | |
|---|---|---|---|---|
| 2,770,241 | A | 11/1956 | Winkler | |
| 3,006,346 | A | 10/1961 | Golding | |
| 3,059,649 | A * | 10/1962 | Bernhard | A24D 1/00 131/340 |
| 3,390,686 | A | 7/1968 | Irby et al. | |
| 3,428,049 | A * | 2/1969 | Cogbill et al. | 131/337 |
| 3,884,246 | A | 5/1975 | Walker | |
| 4,545,391 | A * | 10/1985 | Johnson | A24D 3/043 131/336 |
| 6,273,095 | B1 | 8/2001 | Hsu | |
| 2002/0002978 | A1 | 1/2002 | Hsu | |
| 2003/0172944 | A1 | 9/2003 | Hsu | |
| 2004/0079670 | A1 | 4/2004 | Sendijarevic et al. | |

(Continued)

FOREIGN PATENT DOCUMENTS

| | | | |
|---|---|---|---|
| CN | 2376033 | Y | 4/2000 |
| CN | 1265296 | A | 9/2000 |

(Continued)

OTHER PUBLICATIONS

Second Office Action/Search Report issued by State Intellectual Property Office, P.R. China dated Feb. 8, 2014, for Application No. 201080064055.9, filed Nov. 30, 2010 (including English translation).

(Continued)

*Primary Examiner* — Phu H Nguyen
(74) *Attorney, Agent, or Firm* — Cantor Colburn LLP

(57) ABSTRACT

A smoking article component comprising a viscoelastic material (500).

14 Claims, 6 Drawing Sheets

(56) References Cited

U.S. PATENT DOCUMENTS

| | | | | |
|---|---|---|---|---|
| 2004/0250822 | A1* | 12/2004 | Gosebruch | A24D 3/0237 131/331 |
| 2004/0250824 | A1 | 12/2004 | Gosebruch | |
| 2005/0257798 | A1 | 11/2005 | Hsu | |
| 2006/0029790 | A1* | 2/2006 | Sendijarevic | A61F 5/01 428/306.6 |
| 2011/0180088 | A1* | 7/2011 | Hooper | A24C 5/56 131/365 |

FOREIGN PATENT DOCUMENTS

| | | | | |
|---|---|---|---|---|
| CN | 1332758 | A | | 1/2002 |
| GB | 694436 | A | | 7/1953 |
| GB | 2406780 | | | 4/2005 |
| GB | 2406780 | A | * | 4/2005 |
| GB | 2430175 | A | | 3/2007 |
| JP | 2000236863 | A | | 9/2000 |
| JP | 2004033097 | A | | 2/2004 |
| JP | 2005065515 | A | | 3/2005 |
| WO | 2003059095 | A1 | | 7/2003 |
| WO | 2009/017774 | A1 | | 2/2009 |
| WO | WO-2009109433 | A1 | * | 9/2009 ..... A45C 5/56 |

OTHER PUBLICATIONS

"Examining viscoelastic flexible polyurethane foam", Polyurethane Foam Association, In Touch, vol. 11, No. 1, Jun. 30, 2003, pp. 1-7.

Search Report dated Jun. 19, 2013 by State Intellectual Property Office of People's Republic China for Application 201080064055.9, filed on Nov. 30, 2010.

International Search Report and Written Opinion, dated Mar. 2, 2011, for PCT International Application No. PCT/EP2010/068527, filed Nov. 30, 2010.

International Preliminary Report on Patentability, dated Mar. 29, 2012, for PCT International Application No. PCT/EP2010/068527, filed Nov. 30, 2010.

"Macromolecular Physics", Liang Bo-run, China Textile & Apparel Press, pp. 116-134, Jan. 2001.

Chinese Office Action for Application No. 201080064055.9 dated Aug. 5, 2014.

* cited by examiner

SMOKING ARTICLE COMPONENT

CLAIM FOR PRIORITY

This application is a National Stage Entry entitled to and hereby claims priority under 35 U.S.C. §§ 365 and 371 to corresponding PCT Application No. PCT/EP2010/068527, filed Nov. 30, 2010, which in turn claims priority to British Application Serial No. GB 0921930.4, filed Dec. 16, 2009. The entire contents of the aforementioned applications are herein expressly incorporated by reference.

FIELD OF THE INVENTION

The invention relates to the use of viscoelastic materials in components for smoking articles.

BACKGROUND TO THE INVENTION

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products.

Smoking articles such as cigarettes can comprise a paper-wrapped cylindrical rod of tobacco material and an axially aligned cylindrical filter, through which smoke can be drawn when the tobacco material is combusted. The tobacco material and filter may be joined together by an overlapping section of tipping paper, which is adhered to both of the paper-wrapped tobacco rod and the filter. During smoking, a smoker can grip the smoking article by holding the tipping paper around the filter. Alternatively, for smoking articles which do not comprise a filter, such as cigars, cigarillos and roll-your-own cigarettes, a smoker can grip the smoking article by holding the paper-wrapped rod of tobacco material.

SUMMARY OF THE INVENTION

According to the invention, there is provided a smoking article component comprising a viscoelastic material.

The viscoelastic material may comprise a memory foam.

The memory foam may comprise viscoelastic polyurethane foam.

The viscoelastic material may be provided inside the component.

The viscoelastic material may comprise a distinct layer of viscoelastic material.

The layer of viscoelastic material may have a thickness of between 0.5 mm and 2 mm.

The component may be configured to mould around the external shape of an external object when pressure is exerted against the component by the object.

The component may be configured to deform upon the application of a force by an external object to provide a receiving region in the component, the shape of the receiving region substantially matching an external shape of the object.

The smoking article component may comprise a plug of filter material.

The smoking article component may comprise a filter.

The smoking article component may comprise a smoking article wrapper.

The wrapper may comprise a tipping material.

The wrapper may comprise a plug wrap.

According to the invention, there is also provided a smoking article comprising the smoking article component.

According to the invention, there is also provided a method comprising providing a viscoelastic material in a smoking article component.

DETAILED DESCRIPTION OF EXEMPLARY EMBODIMENTS

For the purposes of illustration only, embodiments of the invention will now be described with reference to the accompanying figures.

Figure 1:
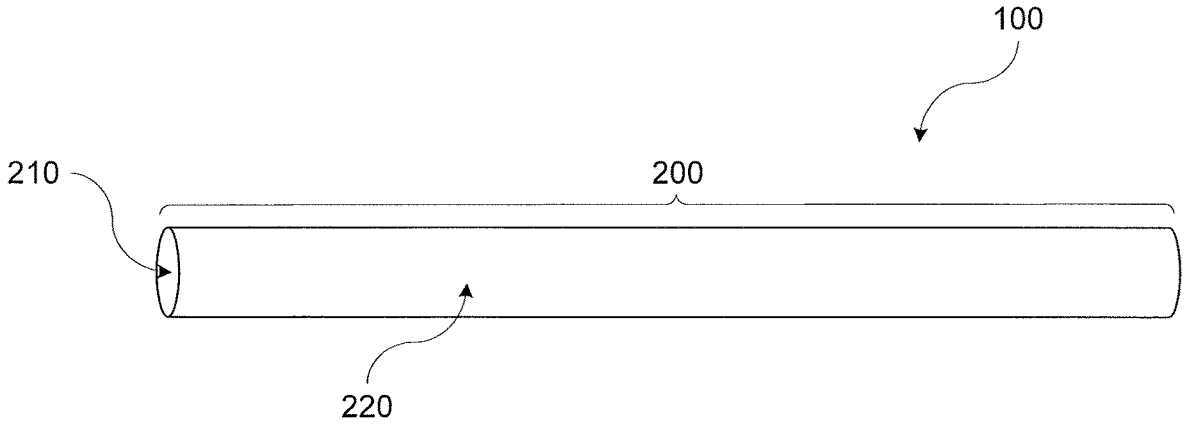
FIG. 1 is an illustration of a smoking article comprising a rod of smokeable material. The rod of smokeable material comprises a substantially cylindrical length of smokeable material wrapped in a wrapper to form a circumferential boundary.

Referring to FIG. 1, a smoking article 100 comprises a generally cylindrical rod of smokeable material 200. The rod of smokeable material 200 may comprise a generally cylindrical length of tobacco material 210, such as a mixture of cut tobacco and reconstituted tobacco, and a wrapper 220 comprising a layer of sheet material wrapped around the tobacco material 210 to form the circumferential outer surface of the rod 200. The conventional terminology in the tobacco industry for a wrapper surrounding the tobacco material is "cigarette paper". However, for the purposes of avoiding confusion with conventional cigarette papers, the wrapper 220 described below will be referred to as a tobacco wrap 220. Nevertheless, the wrapper 220 may comprise cigarette paper.

Figure 2:
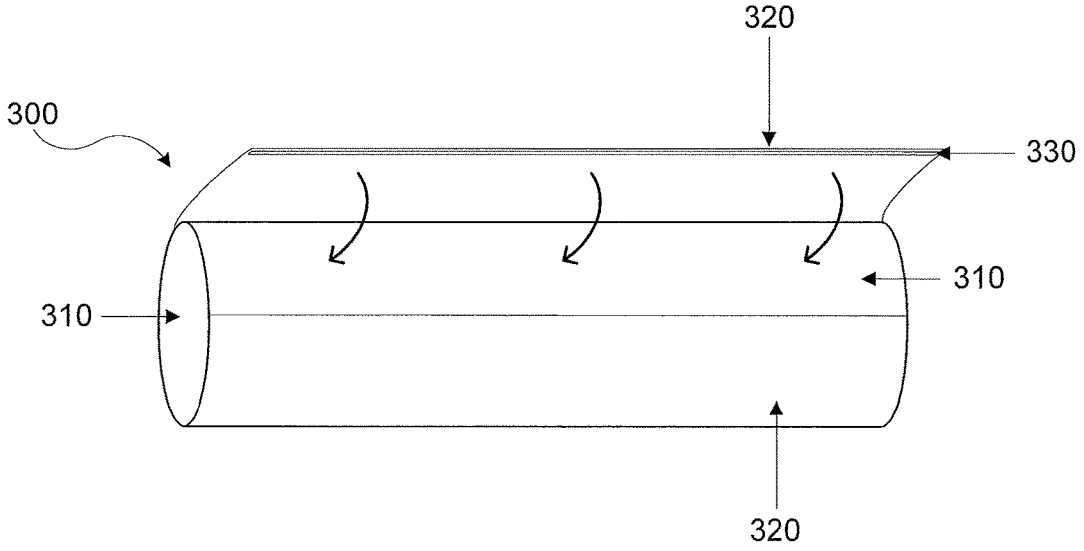
FIG. 2 is an illustration of a partially assembled filter for a smoking article, comprising a plug of filter material and a plugwrap partially wrapped around the plug of filter material.

Referring to FIG. 2, the smoking article 100 may additionally comprise a generally cylindrical filter 300 with approximately the same diameter as the rod of smokeable material 200. As illustrated in FIG. 2, the filter 300 may comprise a substantially cylindrical plug of filter material 310 and a wrapper 320 comprising a layer of sheet material wrapped around the circumferential surface of the plug of filter material 310. The wrapper 320 will be referred to below as a plug wrap 320. The plug wrap 320 may comprise plug wrap paper and may be porous to allow ventilation of the filter material 310. The plug wrap 320 may be held in place around the filter material 310 by gluing along a seam of overlapping material. For example, a stripe of suitable adhesive 330 such as a conventional PVA material may be applied to the interior surface of an overlapping section of the plugwrap 320. This is shown in the partially assembled filter 300 illustrated in FIG. 2.

Figure 3:
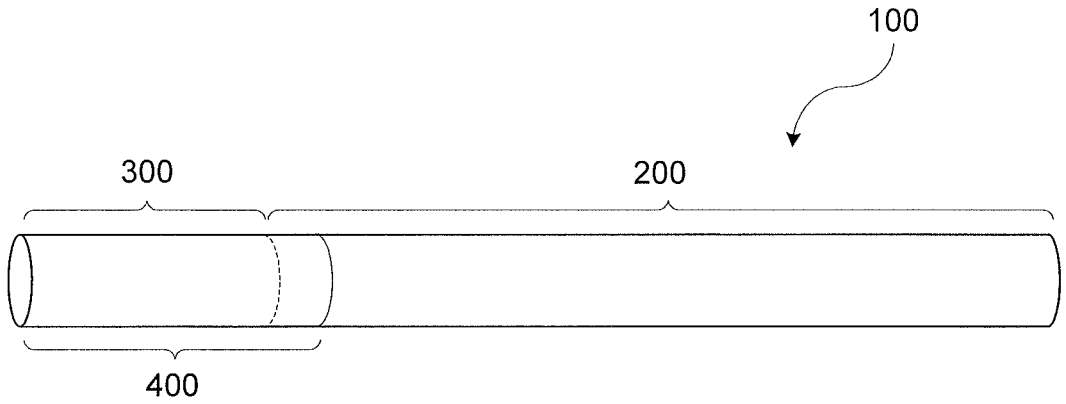
FIG. 3 is an illustration of a smoking article comprising a rod of smokeable material and an axially aligned filter, which is joined to the rod of smokeable material by an overlapping section of tipping material.

Referring to FIG. 3, an end face of the filter 300 may abut an end face of the rod of smokeable material 200 such that the filter 300 and the rod of smokeable material 200 are axially aligned. As illustrated in FIG. 3, the filter 300 and the rod of smokeable material 200 may be joined together by a further wrapper 400, which comprises a section of sheet wrapping material overlapping the join (shown by the dashed line in FIG. 3) between the abutting ends of the rod 200 and the filter 300. The conventional terminology in the tobacco industry for a wrapper overlapping a join between abutting ends of a tobacco rod and a filter is "tipping paper". However, for the purposes of avoiding confusion with conventional tipping papers, the wrapper 400 will be referred to below as a tipping material 400. Nevertheless, the wrapper 400 may comprise tipping paper.

The tipping material 400 may fully circumscribe both of the rod 200 and the filter 300, and may be adhered to the circumferential outer faces of both of the tobacco wrap 220 and the plug wrap 320 using circumferential stripes of PVA material or other suitable adhesive. As shown in FIG. 3, the tipping material 400 may be wrapped around substantially the entire outwardly facing circumferential surface of the plug wrap 320 and approximately one tenth of the tobacco wrap 220. However, it will be appreciated that the tipping material 400 may cover larger or smaller proportions of the tobacco wrap 220 and/or plug wrap 320.

The smoking article 100 may have substantially conventional proportions and dimensions. For example, the diameter of the smoking article may be between 7 mm and 8 mm.

The smoking article 100 may comprise a viscoelastic material 500 such as viscoelastic polyurethane foam. The viscoelastic material 500 may be comprised in any of the smoking article components 220, 310, 320, 400 described above. For example, the viscoelastic material 500 may be comprised in one or more of the tipping material 400, the plug wrap 320, the plug of filter material 310 and the tobacco wrap 220. The viscoelastic material 500 may be evenly distributed throughout the structure of these components 220, 310, 320, 400.

More specifically, the tobacco wrap 220 may comprise a mixture of conventional tobacco wrapping paper 221, such as cigarette paper 221, and viscoelastic material 500. The viscoelastic material 500 and conventional wrapping paper 221 may be distributed throughout the composition of the tobacco wrap 220 in a homogenous manner. The tipping material 400 may comprise a mixture of conventional tipping paper 410 and viscoelastic material 500. The viscoelastic material 500 and conventional tipping paper 410 may be distributed throughout the composition of the tipping material 400 in a homogenous manner. Similarly, the plug wrap 320 may comprise a mixture of conventional plug wrap paper 321 and viscoelastic material 500. The viscoelastic material 500 and conventional plug wrap paper 321 may be distributed throughout the composition of the plug wrap 320 in a homogenous manner.

Additionally or alternatively, the viscoelastic material 500 may comprise a distinct layer of viscoelastic material 500 in one or more of the plug of filter material 310, the plug wrap 320, the tipping material 400 and the tobacco wrap 220. For example, referring to FIGS. 4A to 4C, any of the wrappers described above (tobacco wrap 220, plug wrap 320, tipping material 400) may comprise a two-ply structure, in which a first layer comprises a paper and a second layer comprises the viscoelastic material 500.

Figure 4A:
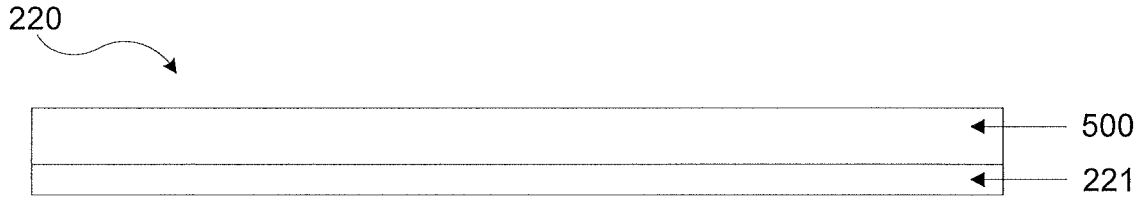
FIG. 4A is an illustration of a two-ply wrapper for wrapping around smokeable material in a smoking article. The two-ply wrapper comprises a layer of viscoelastic material.

More specifically, referring to FIG. 4A, the tobacco wrap 220 may comprise a layer of conventional tobacco wrapping paper 221, such as cigarette paper, and a layer of viscoelastic material 500 provided on the inward and/or outward facing surface of the conventional wrapping paper 221. The layer of viscoelastic material 500 may, for example, be adhered to the inward and/or outward facing surface of the conventional wrapping paper 221 using a suitable adhesive. The viscoelastic material 500 may cover substantially the entire inward or outward facing surface of the conventional wrapping paper 221.

Figure 4B:
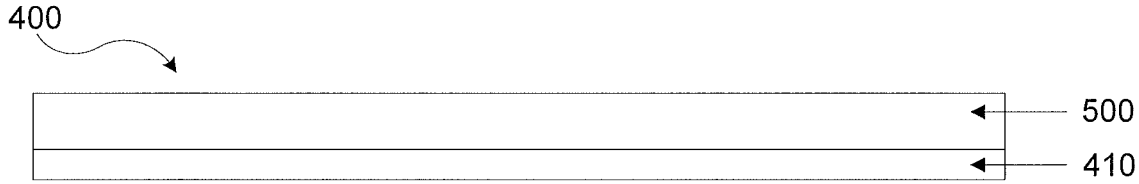
FIG. 4B is an illustration of a two-ply tipping material. The tipping material comprises a layer of viscoelastic material.

Referring to FIG. 4B, the tipping material 400 may comprise a layer of conventional tipping paper 410 and a layer of viscoelastic material 500 provided on the inward and/or outward facing surface of the conventional tipping paper 410. The layer of viscoelastic material 500 may, for example, be adhered to the inward and/or outward facing surface of the conventional tipping paper 410 using a suitable adhesive. The viscoelastic material 500 may cover substantially the entire inward or outward facing surface of the conventional tipping paper 410.

Figure 4C:
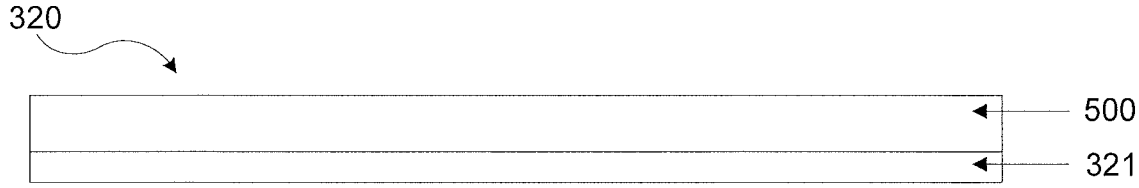
FIG. 4C is an illustration of a two-ply plug wrap. The plug wrap comprises a layer of viscoelastic material.

Referring to FIG. 4C, the plug wrap 320 may comprise a layer of conventional plug wrap paper 321 and a layer of viscoelastic material 500 provided on the inward and/or outward facing surface of the conventional plug wrap paper 321. The layer of viscoelastic material 500 may, for example, be adhered to the inward and/or outward facing surface of the conventional plug wrap paper 321 using a suitable adhesive. The viscoelastic material 500 may cover substantially the entire inward or outward facing surface of the conventional plug wrap paper 321.

Figure 5:
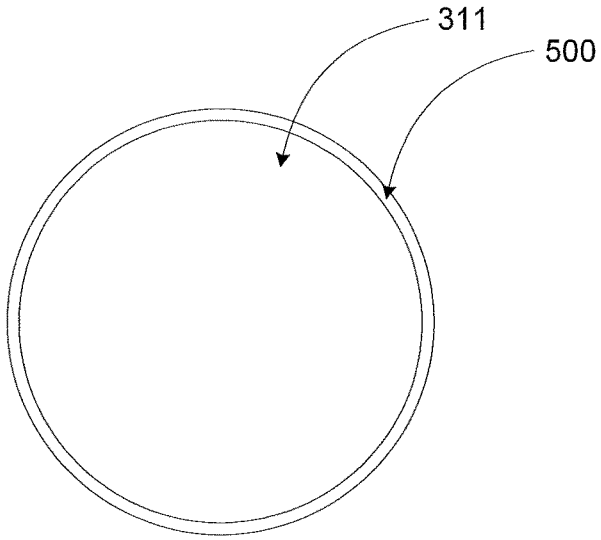
FIG. 5 is an illustration of an end face of a plug of filter material with a viscoelastic material provided at the external surface of the plug of filter material.

Referring to FIG. 5, the plug of filter material 310 may comprise a cylindrical plug of cellulose acetate material 311 and a layer of viscoelastic material 500 provided at the plug's outwardly facing surface. The layer of viscoelastic material 500 may be adhered to the surface of the cellulose acetate material 311 using a suitable adhesive. The viscoelastic material 500 may cover substantially the entire surface of the plug 311.

The smoking article 100 may additionally or alternatively comprise a separate layer of sheet viscoelastic material 500 provided between any two of the smoking article components referred to above. For example, a separate layer of viscoelastic material 500 may be provided between the tipping material 400 and the plug wrap 320, and/or between the plug wrap 320 and the plug of filter material 310. A layer of viscoelastic material 500 may additionally or alternatively be provided on an outward facing surface of either or both of the tipping material 400 or the tobacco wrap 220.

Figure 6:
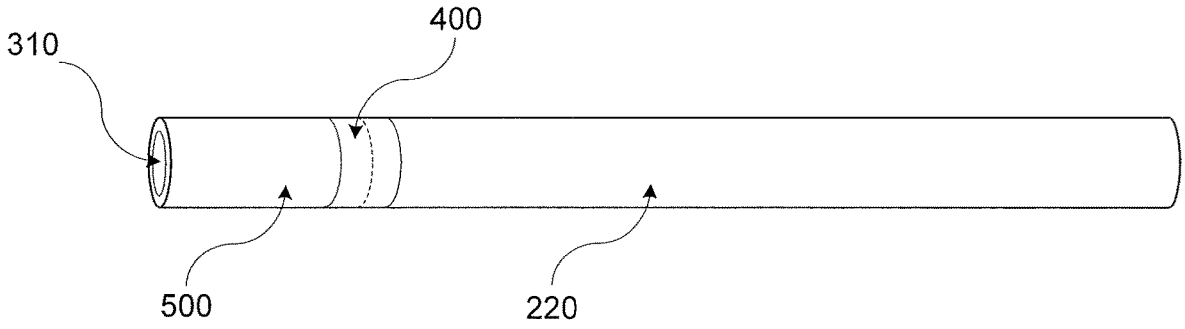
FIG. 6 is an illustration of a smoking article in which the outer surface of the filter is viscoelastic material. The tipping paper is confined to an area immediately adjacent to the join between the rod of smokeable material and the filter.

In another example, the viscoelastic material 500 may be provided as a separate layer around the exterior of the plug of filter material 310 or plug wrap 320 such that the viscoelastic material 500 forms the outer surface of the filter 300. The viscoelastic material 500 will thus be in direct contact with the fingers and/or lips of a user during smoking. Referring to FIG. 6, in this case, the tipping material 400 may comprise ring tipping 400 such that the tipping material 400 is restricted to areas of the smoking article 100 which are immediately adjacent to the join between the rod 200 and the filter 300. As can be seen, the ring tipping 400 does not extend to the mouth end of the filter 300.

The viscoelastic material 500 may comprise a memory foam which is configured to change its shape when pressure is exerted against it. For example, if pressure is exerted against the viscoelastic material 500 by an external object, the material 500 may be configured to form a receiving region 600 in its outer surface. The receiving region 600 may comprise a depression in the viscoelastic material 500. The shape of the depression may substantially correspond to the shape of the part of the object which formed it. The depressed shape may be reflected in the outer surface profile of the smoking article 100.

For example, the viscoelastic material 500 may be configured to mould to the shape of a user's finger, thumb or lip when pressure is imparted by the finger, thumb or lip against the viscoelastic material 500. This may occur when the user grips the smoking article 100 between their finger(s) and/or thumb, or between their lips, thereby imparting pressure against the external face of the smoking article 100. The pressure imparted by the user is experienced by the viscoelastic material 500, which is configured to adapt its shape to create one or more depressed receiving regions 600. The surface profile of each receiving region 600 may substantially match all or part of the outer profile of the finger, thumb or lip which created the region 600. The shape of the one or more receiving regions 600 is reflected in the external surface profile of the smoking article 100.

One or more receiving regions 600, such as those described above, may be simultaneously present in the external surface profile of the smoking article 100. The external surface profile of the smoking article 100 may therefore be shaped to simultaneously accommodate one or more of the user's fingers, thumb or lips. The formation of these regions 600 may make the external profile of the smoking article 100 individual to the user, thereby allowing the user to grip the smoking article 100 more comfortably.

The depth, shape and relaxation rate of the depressed receiving region(s) 600 may be dependent on the temperature of the viscoelastic material 500. For example, the viscoelastic material 500 may become more malleable at higher temperatures, which may result in deeper receiving regions 600 being formed at higher temperatures than at lower temperatures (for an equivalent amount of exerted pressure). It will be appreciated that, due to conduction of heat from the user's body, the temperature of the viscoelastic material 500 may increase when the smoking article 100 is gripped by the user in their fingers or mouth. Therefore, as the temperature of the viscoelastic material 500 increases the depths of the receiving regions 600 may also increase.

When the pressure being imparted against the smoking article 100 is removed, the viscoelastic material 500 may relax back to its original shape. This may cause the depressed receiving region 600 to disappear, thereby substantially restoring the original surface profile of the smoking article 100. The rate at which the viscoelastic material 500, and therefore surface profile of the smoking article 100, relaxes back to its original shape may vary depending on the particular composition of the viscoelastic material 500. The rate of relaxation may also depend on the temperature of the viscoelastic material 500 and on the extent to which it has been deformed. The length of time taken for the viscoelastic material 500 to relax back to its original shape may, for example, be any length of time between one second and five minutes. Alternatively, the composition of the viscoelastic material 500 may be such that the receiving region 600 relaxes back to its original shape immediately after the pressure being applied to the viscoelastic material 500 has been removed.

Figure 7:
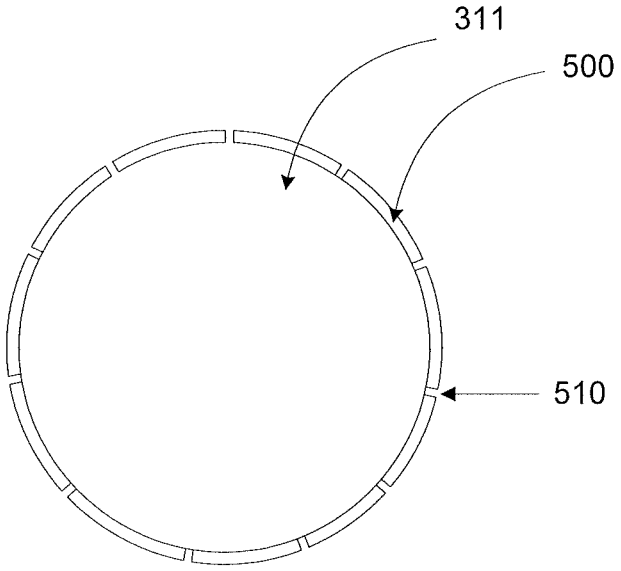
FIG. 7 is an illustration of an end face of a plug of filter material with a perforated viscoelastic material provided at the external surface of the plug of filter material.

The viscoelastic material 500 may comprise a plurality of perforations 510 for allowing gaseous transfer through the material 500. Each of the perforations 510 may comprise a ventilation channel extending between the inward and outward facing surfaces of the viscoelastic material 500, thereby providing a means for ventilating the smoking article 100. For example, the perforations 510 may provide a means for ventilating the plug of filter material 310 by allowing gaseous transfer between the filter material 310 and the exterior of the smoking article 100. An example of this is illustrated in FIG. 7.

It will be appreciated that if the tobacco wrap 220, tipping material 400 or plug wrap 320 comprise viscoelastic material 500, the width of the tobacco wrap 220, tipping material 400 or plug wrap 320 may be greater than is conventional. This is partly illustrated, for example, in FIGS. 4A to 4C. The additional thickness may allow for a perceivably deep depressed receiving region 600 to be formed in the external profile of the smoking article 100. For example, the thickness of the tobacco wrap 220, tipping material 400 or plug wrap 320 may take any value between 0.3 mm and 5 mm. Similarly, the diameter of a plug of filter material 310 comprising a viscoelastic material 500 may also be greater than is conventional.

If the smoking article 100 comprises a distinct layer of viscoelastic material 500 of the type discussed above, the layer may have a thickness of between 0.25 mm and 4 mm. In one example, the layer may have a thickness of between 0.5 mm and 2 mm, for instance 1.5 mm. In another example, the thickness may be between 1 mm and 1.5 mm, for instance 1.25 mm.

Figure 8:
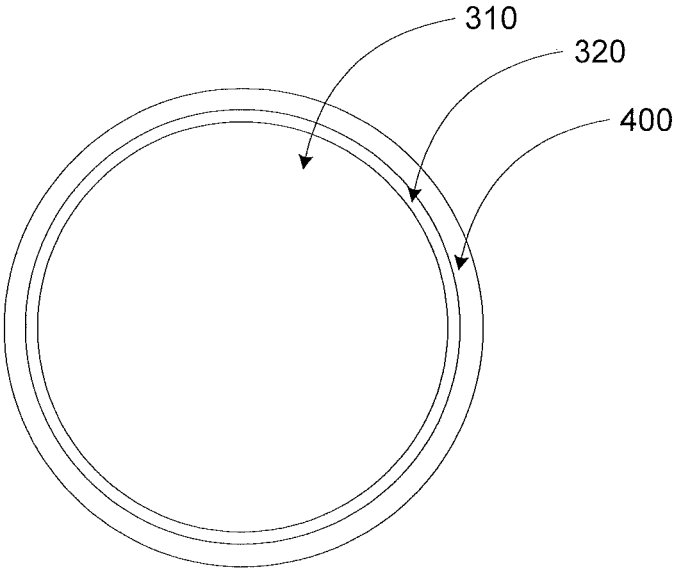
FIG. 8 is a cross-sectional view through a smoking article filter in a smoking article immediately post manufacture. The tipping material and/or smoking article filter comprise a viscoelastic material.

FIG. 8 shows a first cross sectional view along the axis of the smoking article 100. The cross section corresponds to a point approximately halfway along the length of the filter 300. As can be seen, the filter 300 comprises a substantially cylindrical core of filter material 310 wrapped firstly in a sheet of plug wrap 320 and secondly in a sheet of tipping material 400. In the example illustrated in FIG. 8, the tipping material 400 comprises a viscoelastic material 500 and has a greater thickness than the plug wrap 320. However, it will be appreciated that additionally or alternatively, one or both of the plug wrap 320 and plug of filter material 310 could comprise a viscoelastic material 500 in any of the ways described above. The cross-sectional surface profile of each of the filter material 310, plug wrap 320 and tipping material 400 is substantially circular. No depressed regions 600 are present. The view shown in FIG. 8 may therefore correspond to the profile of the smoking article 100 immediately post manufacture or at the point of sale.

Figure 9:
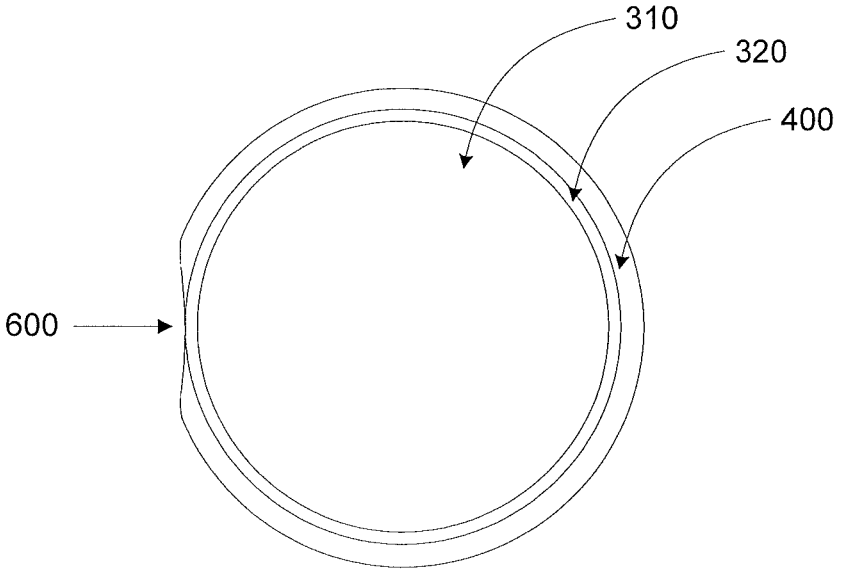
FIG. 9 is a cross-sectional view through a smoking article filter in a smoking article. The tipping material comprises a viscoelastic material. A depressed receiving region has been formed in the tipping material and therefore external surface of the filter by the application of an external force.

FIG. 9 illustrates a second cross sectional view along the axis of the smoking article 100. The smoking article 100 corresponds to the smoking article 100 shown in FIG. 8, in which the tipping material 400 comprises a viscoelastic material 500. The cross sectional view is of the same point on the smoking article 100 as is shown in FIG. 8. As illustrated in FIG. 9, the smoking article 100 comprises a depressed receiving region 600 in its outer surface profile. This is caused by exertion of a force against the surface of the smoking article 100 (in this case the tipping material 400), which has caused the viscoelastic material 500 in the tipping material 400 to deform and mould to the shape of the object which exerted the force. The object itself, which may be a finger or a lip of a user, has been omitted from FIG. 9 for the purposes of clarity.

FIGS. 8 and 9 could alternatively show a separate layer of viscoelastic material 500 around a plug wrap 320 in a smoking article 100 in which ring tipping 400 is used. This is described above in relation to FIG. 6.

Figure 10:
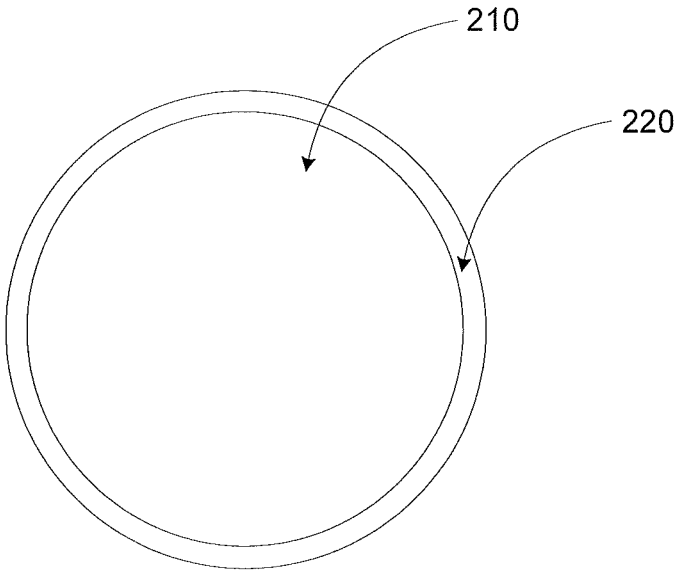
FIG. 10 is a cross-sectional view through a rod of smokeable material immediately post manufacture. The wrapper at the external surface of the rod comprises a viscoelastic material.

FIG. 10 shows a third cross sectional view along the axis of the smoking article 100. The cross sectional view in FIG. 10 corresponds to a point approximately halfway along the rod of smokeable material 200. If the smoking article 100 does not comprise a filter 300, the view in FIG. 10 may correspond to a point anywhere along the smoking article 100. In this example, the tobacco wrapper 220 comprises a viscoelastic material 500. As can be seen, the cross-sectional surface profile of the rod of smokeable material 200 is substantially circular. As with FIG. 8, no depressed regions 600 are present. The view shown in FIG. 10 may therefore correspond to the profile of the smoking article 100 immediately post manufacture or at the point of sale.

Figure 11:
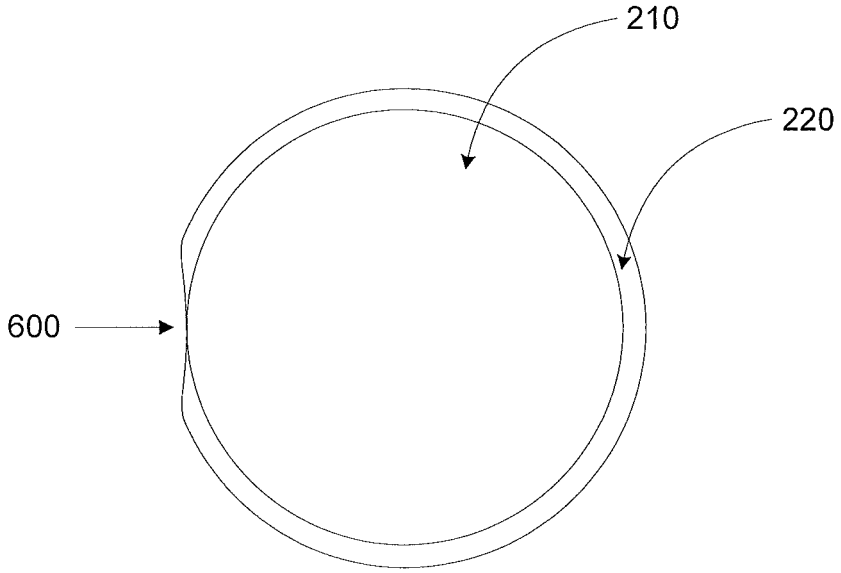
FIG. 11 is a cross-sectional view through the rod of smokeable material shown in FIG. 10 after a depressed receiving region has been formed in the external surface of the rod by the application of an external force to the wrapper.

FIG. 11 illustrates a fourth cross sectional view along the axis of the smoking article 100. The smoking article 100 corresponds to the smoking article 100 shown in FIG. 10, in which the tobacco wrapper 220 comprises a viscoelastic material 500. The cross sectional view is of the same point on the smoking article 100 as is shown in FIG. 10. As illustrated in FIG. 11, the smoking article 100 comprises a depressed receiving region 600 in its outer surface profile. This is caused by exertion of a force against the surface of the smoking article 100 (in this case the tobacco wrap 220), which has caused the viscoelastic material 500 in the tobacco wrapper 220 to deform and mould to the shape of the object which exerted the force. The object itself, which may be a finger or lip of a user, has been omitted from FIG. 11 for the purposes of clarity.

The smoking article 100 described above may be a cigarette, cigar or cigarillo.

The smoking article 100 may be manufactured by applying a layer of viscoelastic material 500 to any of the smoking article components 220, 310, 320, 400 described above in an adhering process. For example, conventional cigarette paper, conventional plug wrap paper and/or conventional tipping paper may be fed into a suitable adhering apparatus which is configured to adhere a layer of viscoelastic material 500 to a surface of the conventional papers using a suitable adhesive. The resulting wrappers 220, 320, 400 may then be provided on bobbins and used to assemble smoking articles 100 such as cigarettes in a conventional fashion. Additionally or alternatively, a length of conventional cellulose acetate filter material 311 may be wrapped in a layer of viscoelastic material 500 using a suitable adhesive, before being cut into lengths ready for conventional smoking article assembly.

All embodiments described above in which the viscoelastic material 500 may be combusted or exposed to burning tobacco material are subject to further safety testing procedures. In particular, those embodiments in which viscoelastic material 500 is provided in the tobacco wrap 220 and/or tipping material 400. Preferable embodiments of the invention are those in which the viscoelastic material 500 is provided in the plug wrap 320 or plug of filter material 310. In all of the embodiments, smoke from the tobacco rod 200 is channelled through the filter material 310 rather than the other filter components referred to above.

It will be appreciated that the alternatives described above may be used singly or in combination to achieve the effects of the invention.

The invention claimed is:

1. A smoking article component, the smoking article component comprising:

a plug of filter material; and a viscoelastic tipping material surrounding the plug of filter material, wherein the viscoelastic tipping material comprises a two-ply structure having a first layer and a second layer in which the first layer comprises a paper and the second layer comprises a viscoelastic material, wherein the second layer comprising the viscoelastic material has a thickness between 0.25 mm and 4 mm, and wherein the viscoelastic tipping material is configured to mold around the external shape of an external object when pressure is exerted against the viscoelastic tipping material by the object.

2. The smoking article component according to claim 1, wherein the viscoelastic tipping material comprises a memory foam.

3. The smoking article component according to claim 1, wherein the viscoelastic tipping material comprises viscoelastic polyurethane foam.

4. The smoking article component according to claim 1, wherein the viscoelastic tipping material has a thickness of between 0.5 mm and 2 mm.

5. The smoking article component according to claim 1, wherein the component is configured to deform upon the application of a force by the external object to provide receiving region in the component, the shape of the receiving region substantially matching the external shape of the object.

6. The smoking article component according to claim 1, wherein the component comprises a plug wrap surrounding the plug of filter material, wherein the viscoelastic tipping material surrounds the plug wrap.

7. The smoking article component according to claim 1, wherein the component comprises a tobacco wrap.

8. The smoking article component according to claim 1, wherein the viscoelastic tipping material is an outermost layer of the component.

9. The smoking article component according to claim 1, wherein the viscoelastic tipping material is provided around an exterior of the plug of filter material or a plug wrap.

10. The smoking article component of claim 1, wherein the viscoelastic tipping material forms an outer surface of a filter.

11. The smoking article component of claim 1, wherein the viscoelastic tipping material is arranged to be in direct contact with the fingers and/or lips of a user during smoking.

12. The smoking article component of claim 1, wherein the second layer is provided on an outer surface of the first layer.

13. A smoking article comprising the smoking article component according to claim 1.

14. A method comprising providing a viscoelastic tipping material in a smoking article component, the viscoelastic tipping material comprising a two-ply structure having a first layer and a second layer in which the first layer comprises a paper and the second layer comprises a viscoelastic material, wherein the second layer comprising the viscoelastic material has a thickness between 0.25 mm and 4 mm.

* * * * *